US006431771B2

(12) United States Patent
Nagai et al.

(10) Patent No.: US 6,431,771 B2
(45) Date of Patent: Aug. 13, 2002

(54) PRINTER

(75) Inventors: Mikio Nagai; Toshihiro Fujimoto; Shohei Nakayama, all of Tokyo (JP)

(73) Assignee: NEC Corporation (JP)

( * ) Notice: Subject to any disclaimer, the term of this patent is extended or adjusted under 35 U.S.C. 154(b) by 0 days.

(21) Appl. No.: 09/809,380

(22) Filed: Mar. 15, 2001

Related U.S. Application Data

(62) Division of application No. 09/478,650, filed on Jan. 6, 2000.

(30) Foreign Application Priority Data

Jan. 7, 1999 (JP) ..... 11-002159
Dec. 9, 1999 (JP) ..... 11-350335

(51) Int. Cl.[7] ..... B41J 11/20
(52) U.S. Cl. ..... 400/56; 400/55; 400/58
(58) Field of Search ..... 400/56, 55, 58

(56) References Cited

U.S. PATENT DOCUMENTS 5,137,377 A * 8/1992 Ito et al. ..... 400/56
5,570,959 A * 11/1996 Moriwaki et al. ..... 400/56

FOREIGN PATENT DOCUMENTS

JP 2-258380 10/1990
JP 6-55784 3/1994

* cited by examiner

*Primary Examiner*—Andrew H. Hirshfeld
*Assistant Examiner*—Charles H. Nolan, Jr.
(74) *Attorney, Agent, or Firm*—Dickstein, Shapiro, Morin & Oshinsky, LLP.

(57) ABSTRACT

A platen together with a frame supporting the platen is rotatably mounted on a shaft and a platen gap is regulated by rotary movement of the frame about that shaft to detect thickness of a printing sheet at a first printing position. The mechanism for setting the platen gap is simplified and precise and the present printer can accommodate even printing sheets whose thickness is partially different. Further, it is detected platen temperature by a simple temperature detecting means and to change the platen position according to the detected temperature by a predetermined value ±Δd for a standard value d0 of the gap.

20 Claims, 16 Drawing Sheets

PRINTER

CROSS REFERENCE TO RELATED APPLICATIONS

This is a division of application Ser. No. 09/478,650, filed Jan. 6, 2000, which claims priority from Japanese Patent Applications No. 11-002159 filed Jan. 7, 1999 and No. 11-350335 filed Dec. 9, 1999.

BACKGROUND OF THE INVENTION

1. Field of the Invention

The present invention relates to a dot impact line printer and, particularly, to a technique for regulating a distance between a printing head and a printing sheet.

2. Description of Related Art

In a dot impact line printer, printing is performed by a printing head with needles. The needles impact a surface of a printing sheet, which is supported by a platen, through an ink ribbon so as to form dots in the printing sheet. The depth at which the needles penetrate the pointing sheet is determined by input character information. Printing depth and the ink contrast becomes deeper by making the stroke of the printing head needles longer and paler by making the stroke shorter. Therefore, for constant printing, it is necessary to make the stroke distance constant, that is, to maintain a constant distance between the printing head and the printing sheet. The distance between the printing head and a platen will be referred to as "platen gap", hereinafter.

FIG. 1 shows a construction of a main portion of a conventional dot impact line printer. As shown in FIG. 1, the distance between printing mechanism 19 and platen 3 is regulated by rotating ball screws 53 and 54 by platen driven portions 50 and 51. Guide rails 60 and 61 are used to move the platen 3 in parallel precisely. Further, in order to move platen 3 in parallel precisely, platen driving portions 50 and 51 are synchronized with each other by drive synchronizer 52.

FIGS. 2 and 3 show a procedure for detecting a thickness of a printing sheet of a conventional dot impact line printer. As shown in FIG. 2, it is possible to detect the printing sheet thickness by urging printing sheet thickness sensor 55 against sensor support 20 through printing sheet 40. As shown in FIG. 3, platen 3 is moved to a predetermined position according to the thickness of the printing sheet thus detected.

An automatic sheet thickness detection mechanism disclosed in, for example, Japanese Patent Application Laid-open No. H6-055784 comprises a platen, which is moved from an initial position toward the side of a printing mechanism by an elevator mechanism using a lead screw to regulate a platen gap, a sheet thickness detection sensor fixed to the platen to determine the platen gap, a detection rod engaged with the sheet thickness detection sensor and in contact with a printing sheet to move according to the thickness of the printing sheet and a home position sensor for detecting the initial position of the platen. The platen is moved in parallel toward the side of the printing mechanism until the sheet thickness detection sensor operated by the movement of the detection rod corresponding to the sheet thickness is returned to an idle state.

A sheet thickness regulation mechanism disclosed in, for example, Japanese Patent Application Laid-open No. H2-258380 comprises a manual switch for manually selecting between an automatic setting mode and a selective setting mode, a switch for selecting a platen gap suitable for special sheets having partially different sheet thickness and a memory for storing data corresponding to the appropriate platen gaps for the special sheets.

As shown in FIG. 1, it is necessary to synchronize platen driving portion 51 provided in one end of platen 3 with platen driving portion 51 provided in the other end thereof with high precision. Further, it is necessary that ball screws 53 and 54 have substantially the same operating characteristics and the regulations thereof must be performed frequently.

That is, in order to move the long platen in parallel precisely by the elevator mechanism using such as lead screw, a complicated guide structure and a synchronizing structure for synchronizing both ends of the platen are necessary. Further, a large amount of regulation is necessary even after an assembling of the mechanisms.

As shown in FIGS. 4 and 5, which show problems related to conventional sheet thickness detection, it si impossible to set appropriate platen gaps for sheets having partially different thicknesses. For example, if a label sheet having four rounded corners is different in thickness between a label sheet portion and a peeling portion thereof, sheet thickness detection sensor 55 detects the thickness of the peeling sheet portion as shown in FIG. 4. When the position of platen 3 is set according to the detection data as shown in FIG. 5, it is necessary, in order to maintain speed in printing on the label portion, to maintain a response frequency of the printing mechanism. The response frequency depends upon a specific vibration frequency of the printing mechanism, the platen gap and a rebound coefficient of the sheet, etc. The rebound coefficient depends upon the thickness of the printing sheet and the number of sheets to be printed, etc. It is usual that the rebound coefficient is inversely proportional to the thickness of the printing sheet and, with the same platen gap, the response frequency of the printing mechanism becomes lower when the thickness of the printing sheet is increased. Therefore, the platen gap [becomes] will not be appropriate for the printing speed. In such case, it is usual that an operator confirms the thickness of the printing sheet at a printing position and instructs a change of the thickness of the sheet, which is automatically detected by the printing device.

Further, such printing device is usually requested to maintain the response frequency in order to maintain the printing speed. Since the response frequency depends upon a specific vibration frequency of the printing mechanism, the platen gap and a rebound coefficient of the sheet, etc., and the rebound coefficient depends upon the thickness of the printing sheet and the number of sheets to be printed, etc., and since the rebound coefficient is inversely proportional to the thickness of the printing sheet and, with the same platen gap, the response frequency of the printing mechanism becomes lower when the thickness of the printing sheet increased, there is a limit to the printing speed. However, there is no particular prior art considering this problem.

SUMMARY OF THE INVENTION

An object of the present invention is to provide a printer having a platen gap setting mechanism with a simple construction and high precision. Another object of the present invention is to provide a printer capable of setting an appropriate platen gap corresponding to a printing sheet having partially different thicknesses.

According to the first aspect of the present invention, a printer includes a printing head, and a platen arranged with a gap with respect to the printing head. The platen is pivotally coupled to a support to move towards and away from a printing path, a detector for detecting a thickness of a printing sheet, and an actuator for pivoting the platen about an axis of the support as a function of the detected thickness of the printing sheet. The support has a shaft provided in parallel to the platen and a frame rotatably supported by the shaft at two points, for supporting a center shaft of the platen at two points. As a result, an angle of the platen with respect to the shaft of the frame is easily regulated.

That is, in the printer of the present invention, the platen is mounted on the shaft, which is rotatable together with the frame. Therefore, it is possible to regulate the platen gap by the rotation of the frame about that shaft.

Thus, it is possible to remove the complicated platen driving portions at both ends of the platen, the guide rails and the drive synchronization portion, which are indispensable in the conventional printer.

It is preferable that the printing sheet feeder preferably includes means for automatically moving the sheet position detected by the detector for detecting the thickness of the printing sheet to the printing position.

That is, the printer of the present invention detects the thickness of the printing sheet at a first printing position. Therefore, it is possible to set a correct platen gap even when a sheet having partially different thicknesses is used.

Further, a table recorded with the gaps to be set for the sheet thickness detected by the detector is preferably provided. That is, it is possible to relax the influence of the rebound coefficient of the printing sheet, which is reduced with an increase of the thickness of the sheet, on the response frequency to thereby maintain the printing speed and improve the printing performance of the printer, by controlling the operation of the printer on the basis of the detected thickness of the printing sheet with using, for example, a gap table recorded with the air gap between a surface of the printing sheet and the printing mechanism, which is reduced with an increase of the thickness of the printing sheet, and provided in the memory.

The detector may be supported by the frame. That is, the construction of the printer can be further simplified by constructing the sheet thickness detector such that it is supported by the same frame as that supporting the platen.

According to the second aspect of the present invention, it is provided a printer which is characterized by comprising means for adjusting and controlling the platen gap, the gap between the printing head and the surface of printing sheet, responding to temperature variation of the platen. That is, the printer of the present invention is characterized by including a printing head, a platen arranged with a gap with respect to the printing head, means for feeding printing sheets into a gap between the printing head and the platen, means for detecting the temperature of the platen and means for adjusting said distance automatically by a predetermined value $\pm\Delta d$ for reducing changes of said distance corresponding to a temperature information output from the detector.

In recent years, as it is required for a dot impact line printer to print faster, it is increased the number of needles arranged vertically. That is, it is developed a printer which has a vertically longer printing head to print a plurality of lines simultaneously. Consequently, it makes the diameter of a platen lager. Although a platen is made by a cylindrical substrate of light alloy such as aluminum with a hard lubber material pasted on the substrate, the lager the diameter of the platen, the greater the rotation driving moment becomes. Therefore, an alloy is used which is as light as possible in weight for its substrate and the cylinder is made thinner.

The other side, as heat capacity becomes smaller because thickness of the platen cylinder is made thinner, temperature variation of the platen becomes larger if it is repeated to print, to pause, etc. Responding to this temperature variation, heat expansion and shrinking of the metal material causes the diameter of the platen to change and the platen gap to change. In selecting the material of the platen substrate, it has been considered to make the material light in weight or hard. However, it has not been considered to select a metal material which makes the heat expansion coefficient of the platen substrate small.

As described above, the platen gap is important for printing quality. If the gap varies on printing execution, printing thickness changes. On a practical printer in which the change of the platen gap is large, an ink ribbon may contact with the printing sheet surface to stain it. In the first aspect of the present invention, the platen gap can be automatically controlled to become constant precisely by detecting the platen gap using a simple mechanism.

The second aspect of the invention is achieved on the above background to provide a low cost printer in which printing quality does not change due to temperature variation of the platen. In the printer of the second aspect of the invention, by forming the platen thin, thermal capacity of the platen becomes small so that a constant printing quality can be maintained if it becomes greater for the platen shape to be influenced by temperature variation. According to the second aspect of the invention, the degree of freedom of materials which may be selected is increased. In a printer which also comprises a mechanism to adjust the platen gap responding to the thickness of the printing sheet used, if it is changed to design, printing quality does not change due to temperature variation. Printing quality does not change even if the temperature of the platen varies during printing execution. Changes in a line are hardly visible by controlling the platen gap corresponding to the temperature variation. Even if printing is continued or interrupted, printing quality does not change and the ink ribbon does not contact the printing sheet surface to stain the print finish.

The printer according to the second aspect of the invention does not detect the platen gap directly during printing execution, but detects the platen temperature by a relatively low price temperature-electricity converter such as a thermistor, to record the value $\pm\Delta d$ that should be adjusted into the standard value of the platen gap corresponding to the temperature information output from the temperature-electricity converter for each product or sample, and to control the platen gap by using the recorded value and the temperature information. It is not also a closed-loop automatic control which detects the gap on every adjusting and controls is always constant. By the second aspect of the present invention, printing quality can be controlled constant enough for practical use.

By the second aspect of the invention, a dot impact line printer is provided which can maintain printing quality constant enough for practical use at a low cost without providing any high cost means for detecting the platen gap by non-contact means or for controlling automatically by a closed loop.

The present arrangement can be embodied in prior printer which comprises means for regulating the platen gap corresponding to the thickness of the printing sheet used, with a small change of where the means for detecting the thickness of the printing sheet and means for regulating the platen gap automatically by using a detected thickness information of the printing sheet as well as said temperature information are provided.

Said means for regulating the platen gap may include a thickness table having previously stored gaps to set for the thickness information of the printing sheet, a temperature table having previously stored gaps to change for the temperature information, first control means for regulate the gap by receiving thickness information of the supplied sheet and referring to the thickness table and second control means for adjusting the gap by retrieving the temperature information on printing execution and referring to the temperature table.

This arrangement can be realized by adding hardware means for detecting the temperature information and supplying it to a control portion on the printer which can regulate the platen gap for the thickness of the printing sheet with adding no hardware and with changing software for controlling.

The second control means is preferably set to adjust the platen gap on printing execution. By such an arrangement, if the platen gap is changed during printing execution, no irregularity of printing is visible on the printed sheet.

The second control means can make the printing finish natural by executing adjustment for every gradual width change within a degree that a change of printing quality can be recognized.

BRIEF DESCRIPTION OF THE DRAWINGS

Specific embodiments of the present invention will now be described, by way of example only, with reference to the accompanying of drawings in which.

DETAILED DESCRIPTION OF THE PREFERRED EMBODIMENTS

Figure 1:
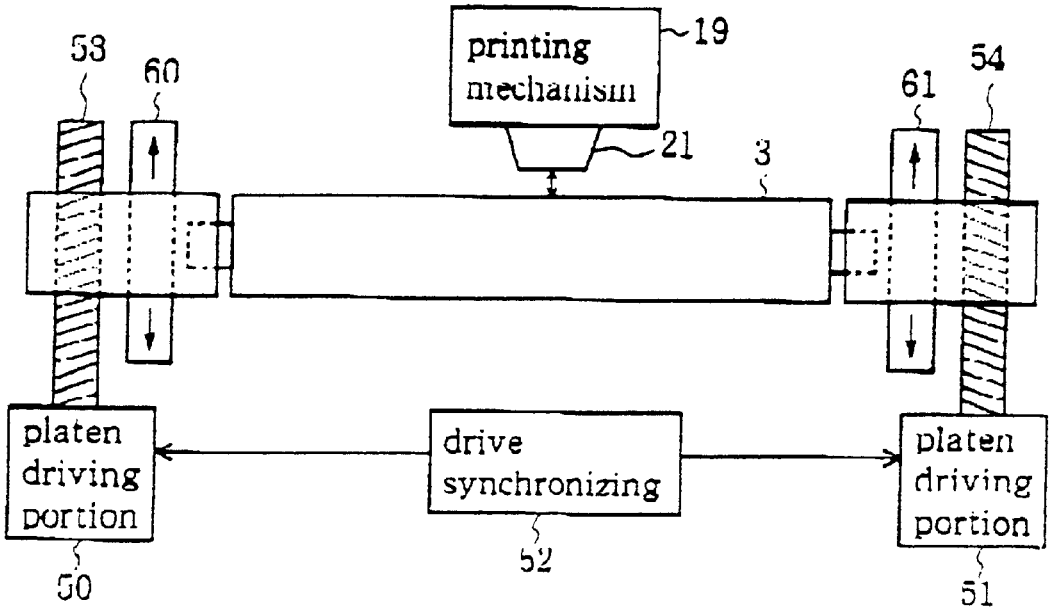
Prior Art FIG.1
FIG. 1 shows a construction of a main portion of a conventional dot impact printer
Figure 2:
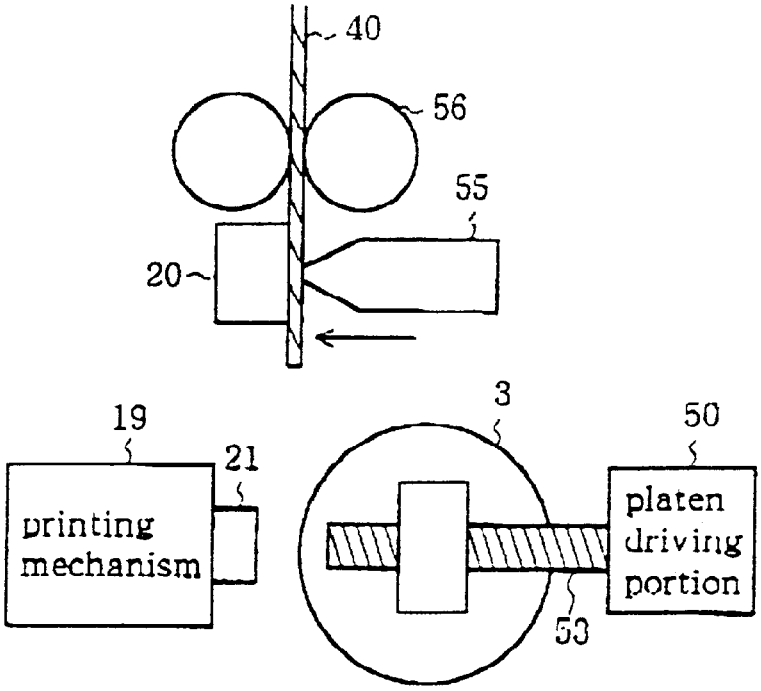
Prior Art FIG.2
FIG. 2 shows a sheet thickness detection procedure of the conventional dot impact printer.
Figure 3:
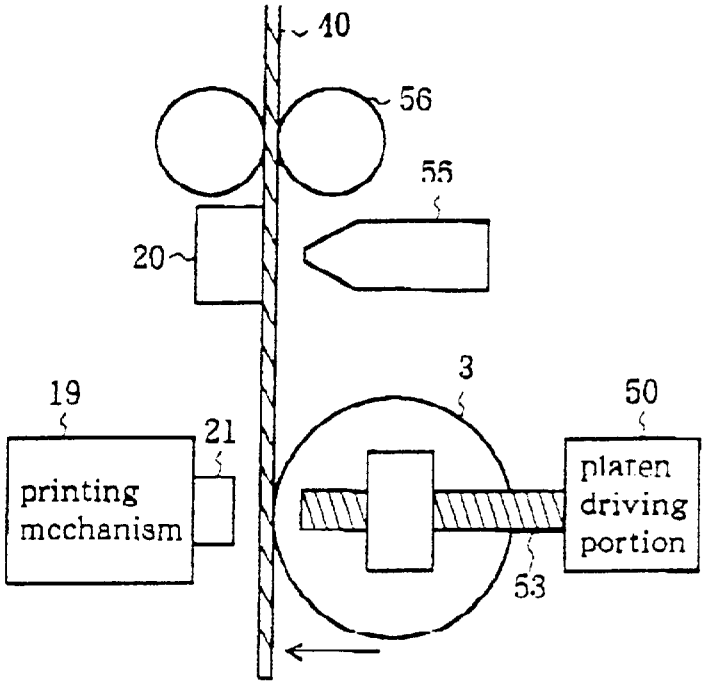
Prior Art FIG.3
FIG. 3 shows a sheet thickness detection procedure of the conventional dot impact printer.
Figure 4:
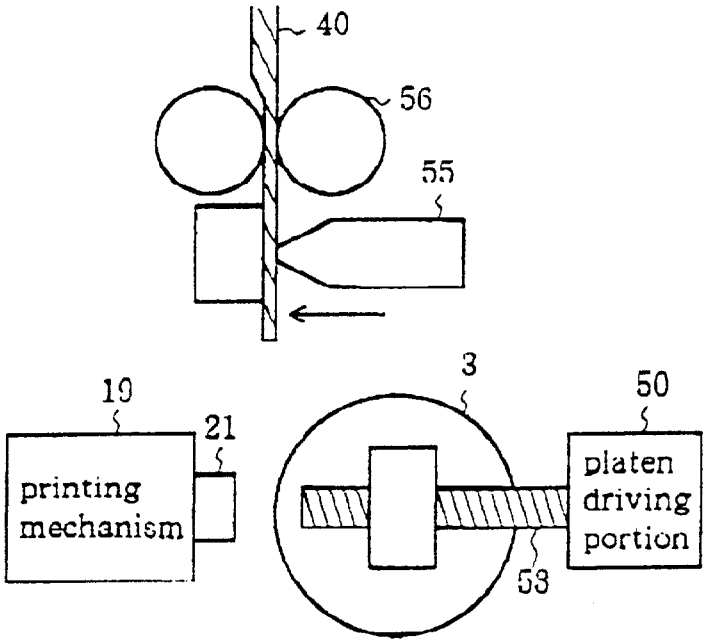
Prior Art FIG.4
FIG. 4 shows problems related to the conventional sheet thickness detection.
Figure 5:
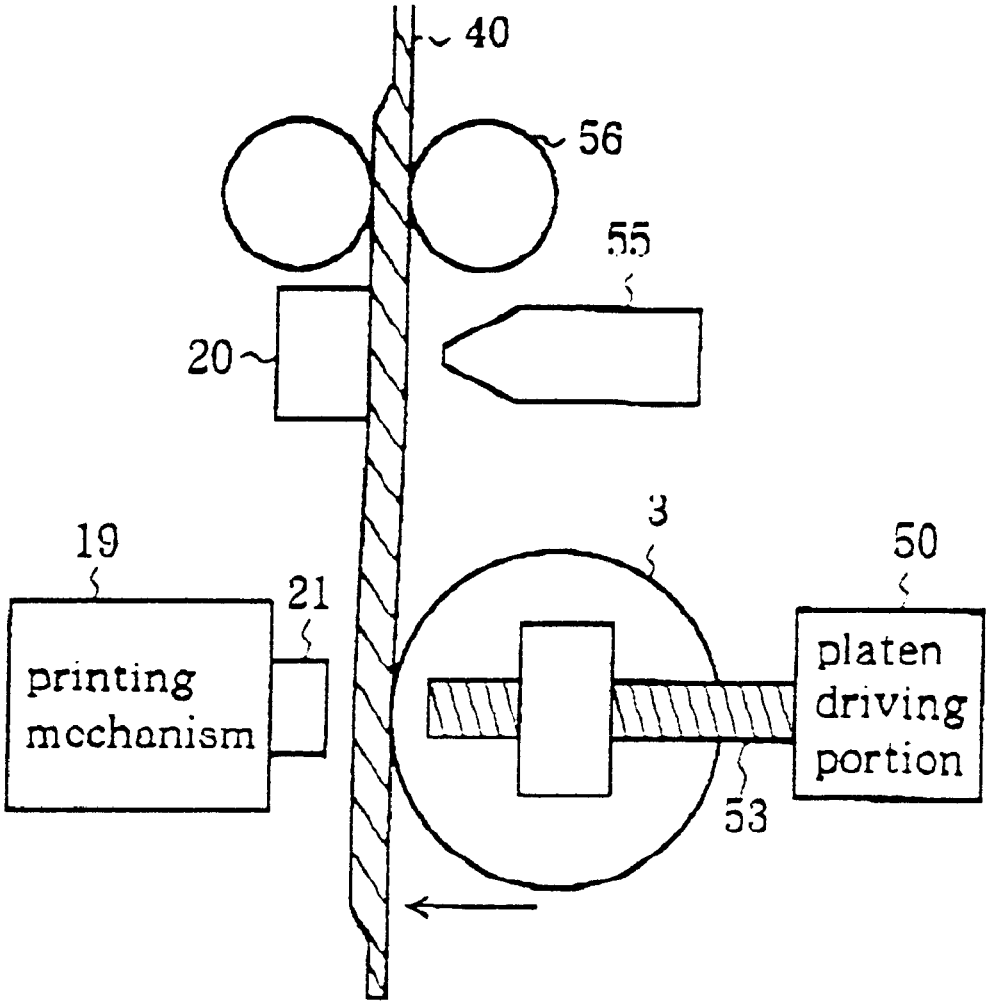
Prior Art FIG.5
FIG. 5 shows problems related to the conventional sheet thickness detection.
Figure 6:
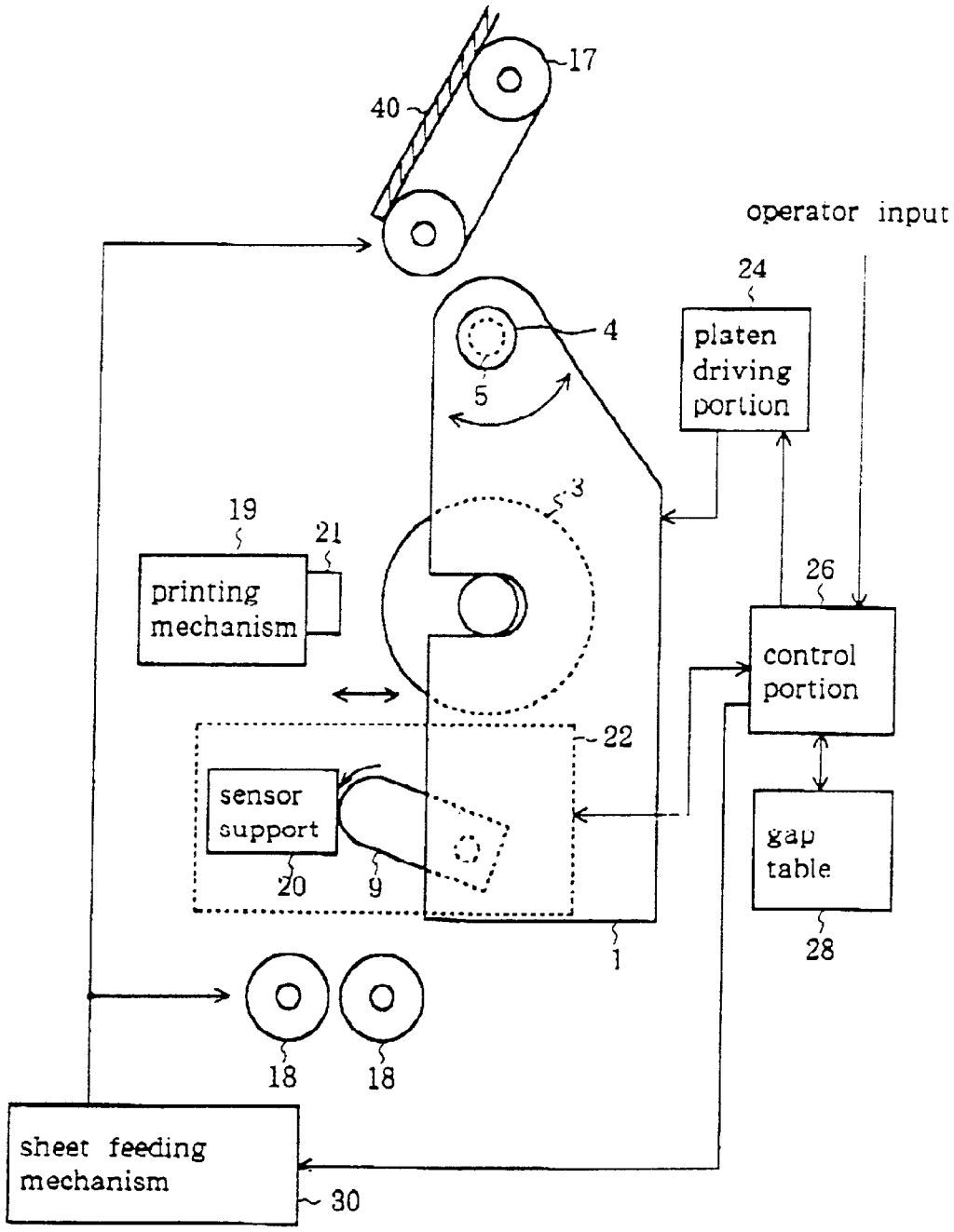
FIG. 6 shows a block circuit diagram of a main portion of the first embodiment of the present invention.

The first embodiment of the present invention comprises, as shown in FIG. 6, printing head 21, platen 3 arranged with a gap with respect to printing head 21, tractor 17 and feed roller 18, which construct a feeder for feeding a printing sheet into between platen 3 and printing head 21, sheet thickness detector 22 for detecting the thickness of the printing sheet and control portion 26 for regulating the gap according to a result of detection from sheet thickness detector 22. The printer of the present invention is featured by further comprising shaft 5 provided in parallel to platen 3 and AGA frame 1 supported by shaft 5 rotatably at two points, for supporting a center shaft of platen 3 at two points, wherein control portion 26 regulates a rotation angle of platen 3 with respect to shaft 5 of AGA frame 1 by controlling platen drive portion 24.

Tractor 17 automatically moves a sheet position detected by sheet thickness detector 22 to a printing position. Further, the printer of the present invention comprises a gap table recorded with the gap to be set with respect to the thickness of the printing sheet detected by printing sheet thickness detector 22. Sheet thickness detector 22 is also supported by AGA frame 1.

Figure 7:
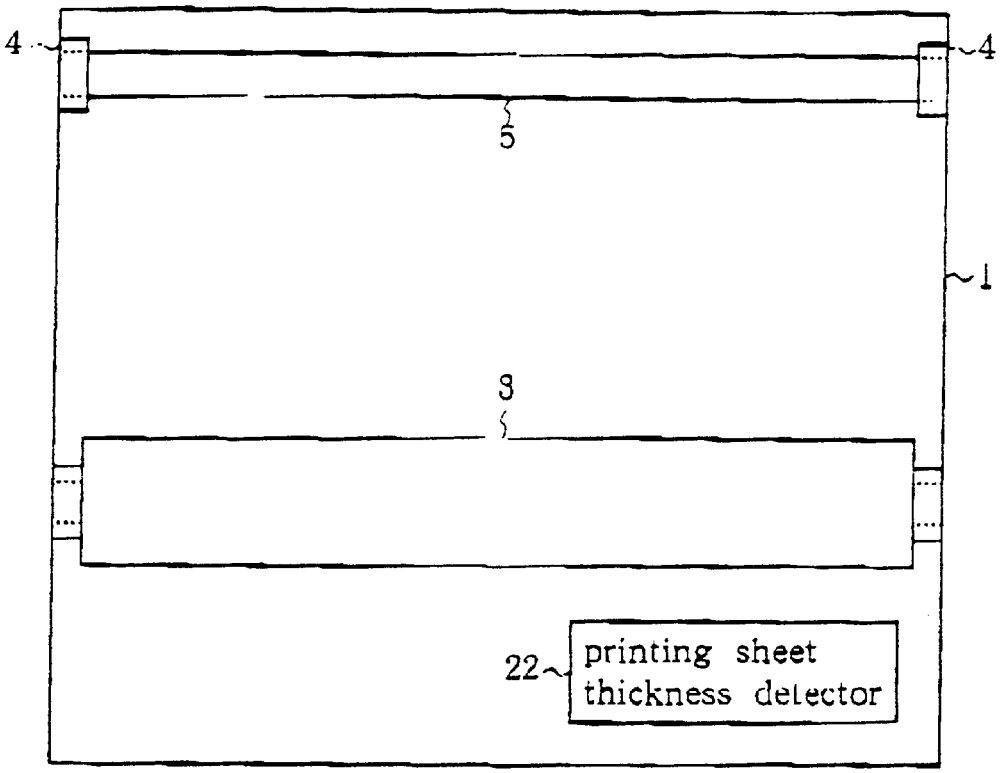
FIG. 7 is a front view of an AGA frame shown in FIG. 6.

Since the printer of this embodiment can regulate the platen gap by moving AGA frame 1 as shown in FIG. 7, it is possible to set the platen gap with high precision even when platen 3 is long.

Figure 8:
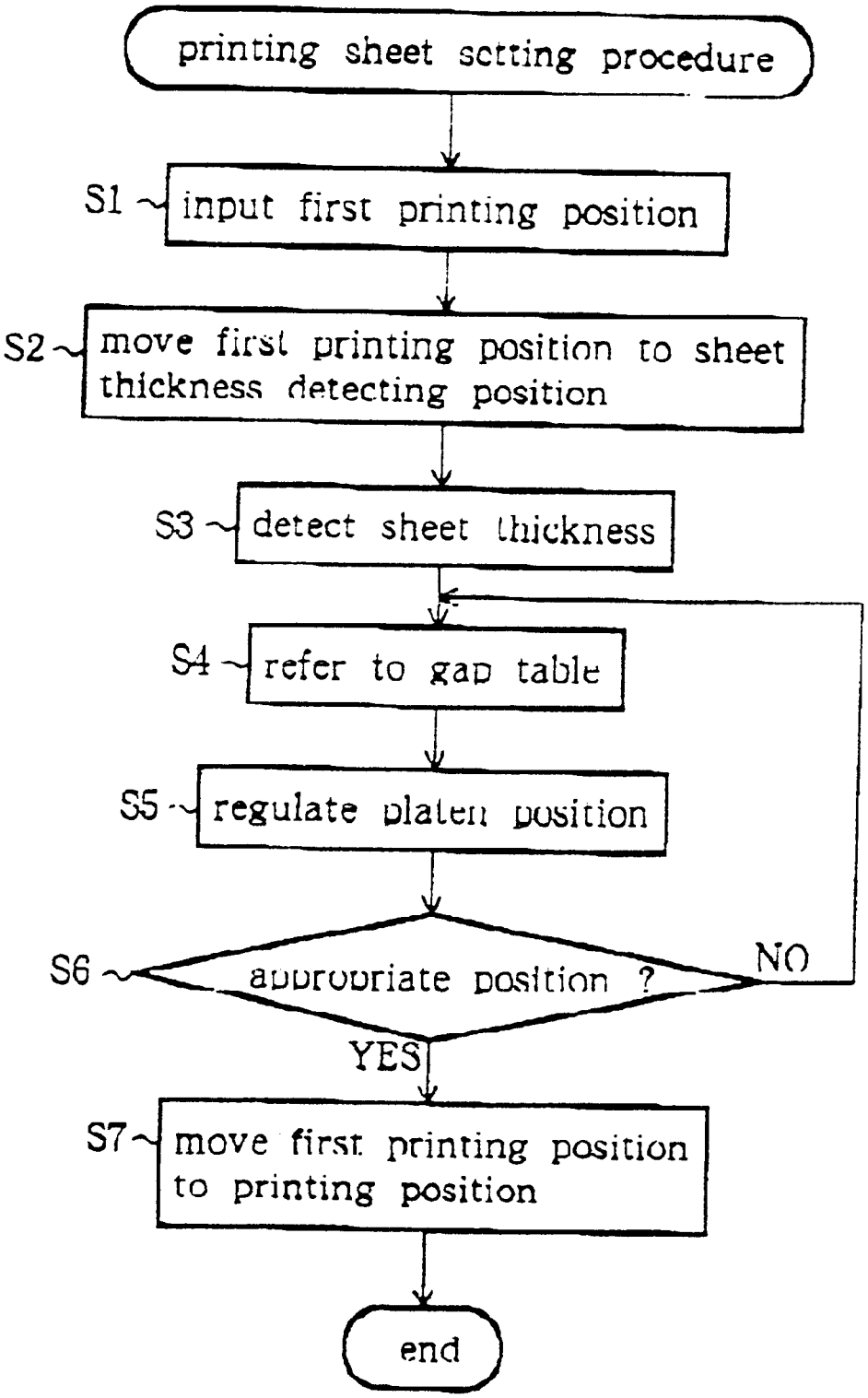
FIG. 8 is a flowchart showing a printing sheet setting procedure of the present invention.
Figure 9:
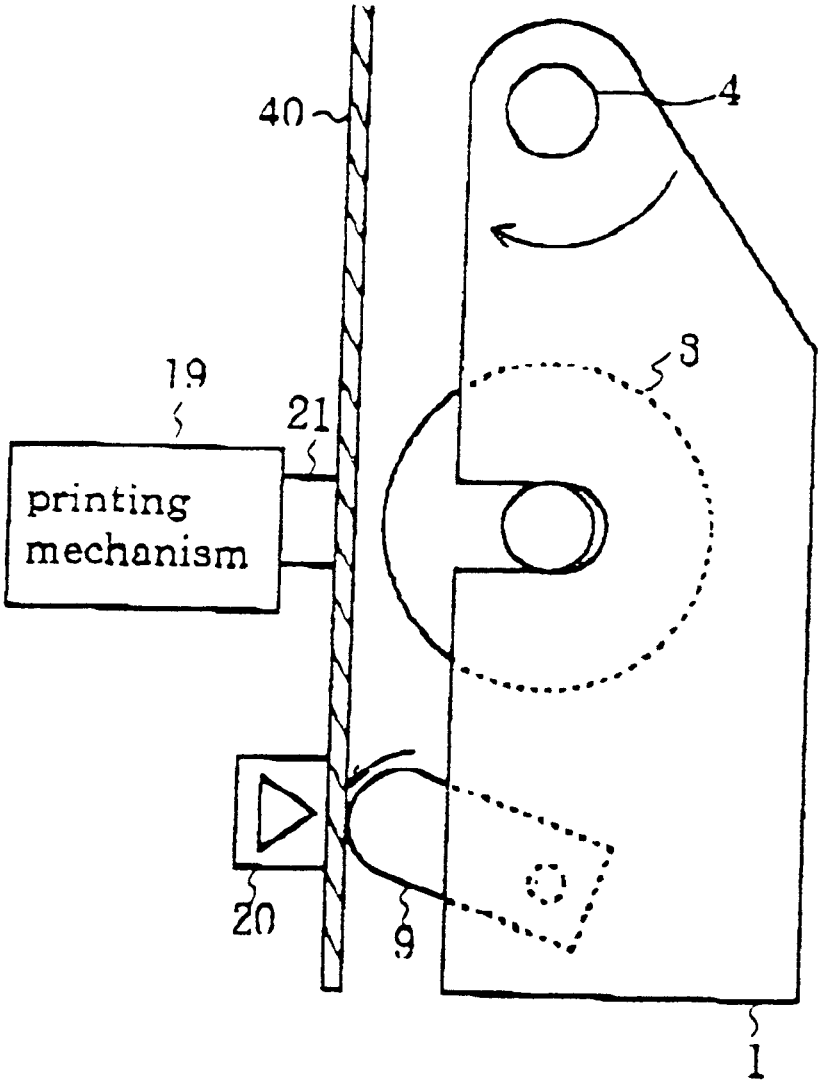
FIG. 9 illustrates the printing sheet setting procedure of the present invention.
Figure 12:
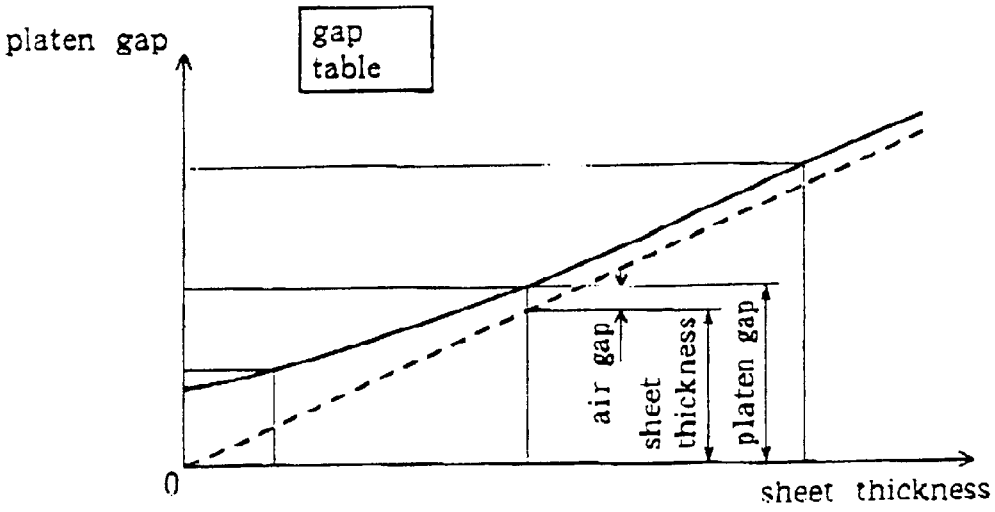
FIG. 12 shows a content of a gap table.

As shown in FIG. 8, a sheet setting procedure in the printer of this embodiment is performed in such a way that, when an operator inputs a first printing position (S1), control portion 26 moves a first printing position of sheet 40 up to a position of lever arm 9 of sheet thickness detector 22 (S2). This situation is shown in FIG. 9. The first printing position is shown by a triangle mark in FIG. 9. The thickness of the sheet is detected by lever arm 9 falling down to the side of sensor support 20 (S3). Control portion 26 refers to gap table 28 with a result of detection from thickness detector 22 (S4). As shown in FIG. 12, an abscissa of gap table 28 indicates the thickness of the printing sheet and an ordinate thereof indicates the platen gap. Control portion 26 can determine the desired platen gap corresponding to the printing sheet thickness by referring to gap table 28. Gap table 28 is set such that the thicker sheet 40 becomes the narrower the air gap from a surface of sheet 40 to printing head 21 to relax the influence of the rebound coefficient of the sheet, which is reduced with an increase of the sheet thickness, on the response frequency to thereby maintain the printing speed and improve the printing performance of the printer.

Figure 10:
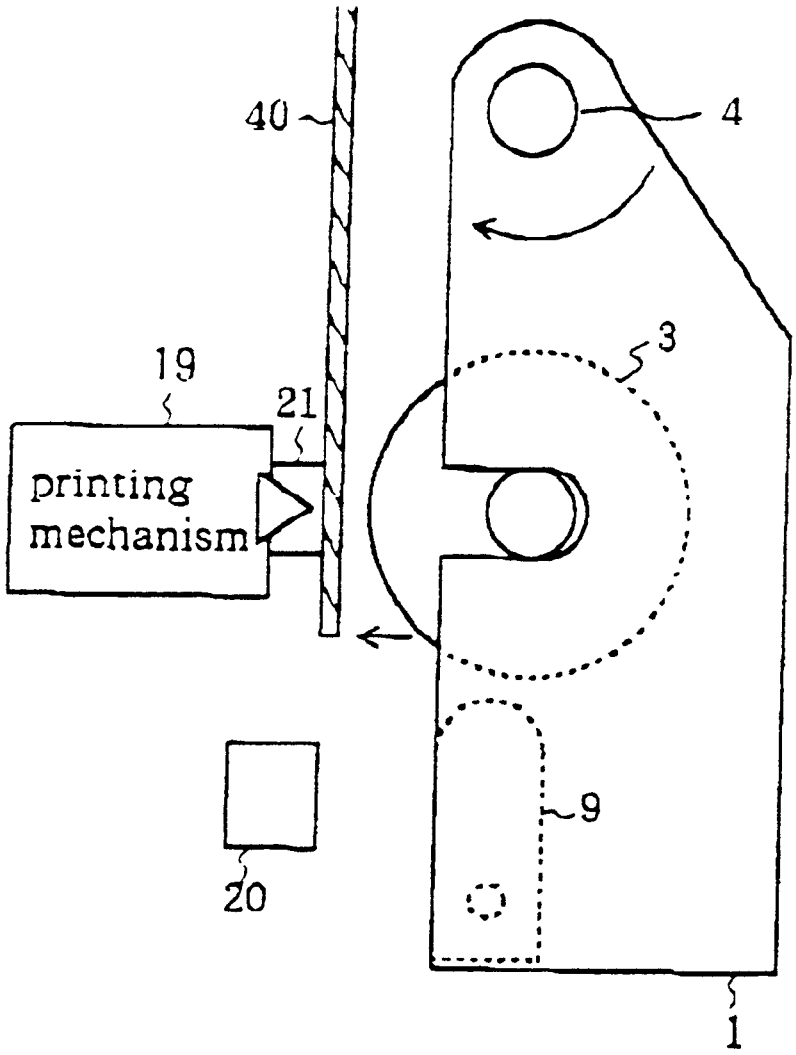
FIG. 10 illustrates the printing sheet setting procedure of the present invention.
Figure 11:
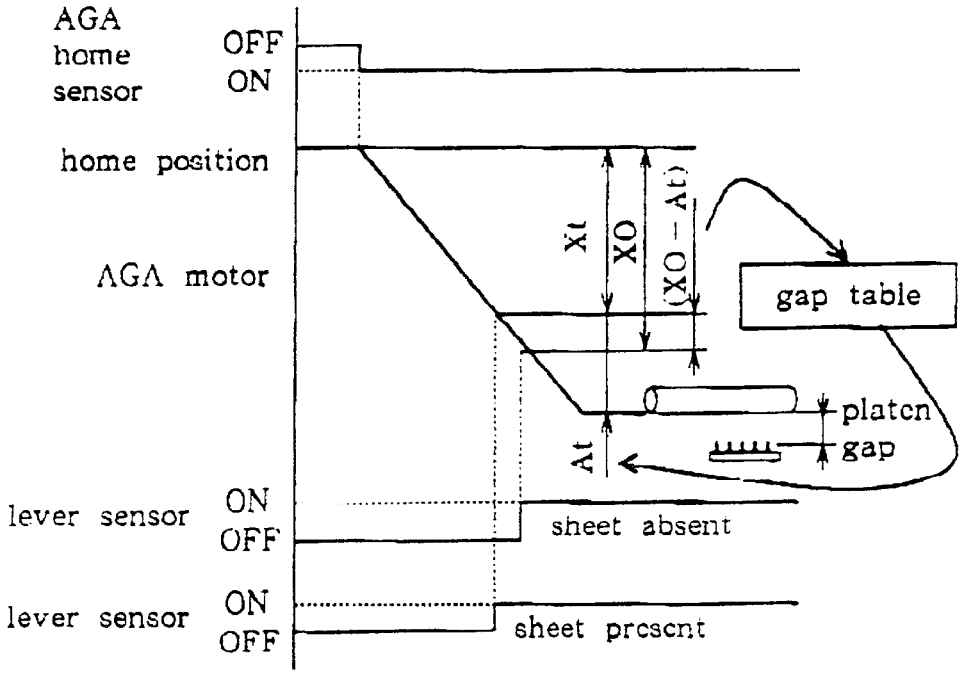
FIG. 11 is a time chart showing a platen gap setting procedure.

Control portion 26 regulates the platen position by controlling platen drive portion 24 according to the platen gap thus determined (S5). When the movement of platen 3 to an appropriate position is completed (S6), the first printing position of sheet 40 is moved to the printing position as shown in a triangle mark shown in FIG. 10 (S7). Thus, it is possible to obtain an appropriate platen gap even when sheet 40 has partially different thicknesses.

Figure 13:
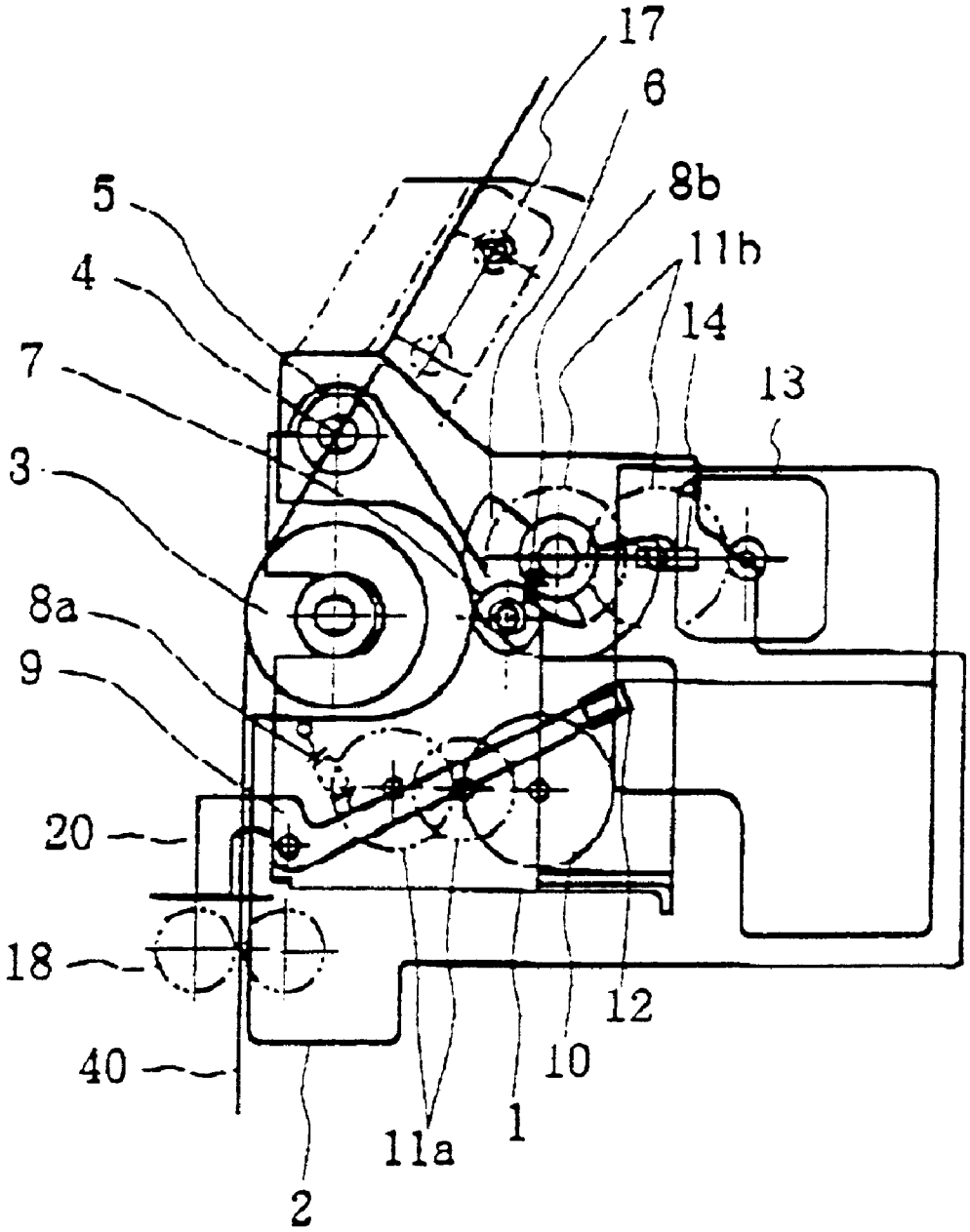
FIG. 13 shows a concrete construction of a printer according to an embodiment of the present invention.
Figure 14:
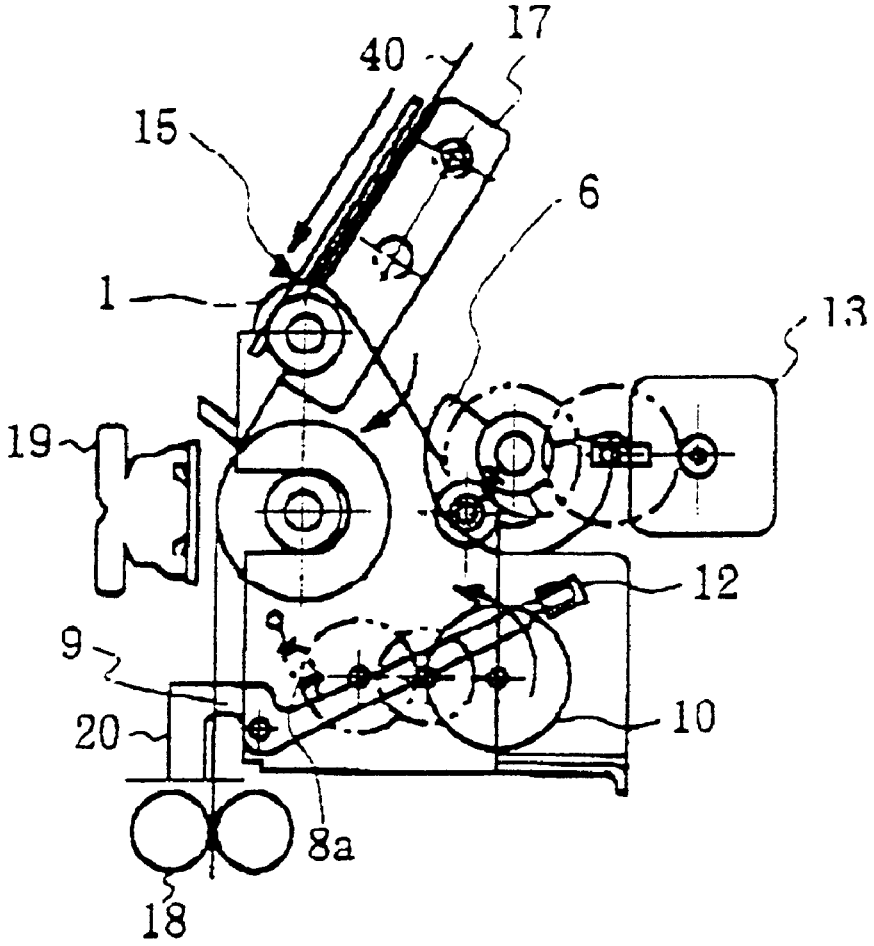
FIG. 14 schematically shows a sheet thickness detection procedure in the printer according to the embodiment of the present invention.
Figure 15:
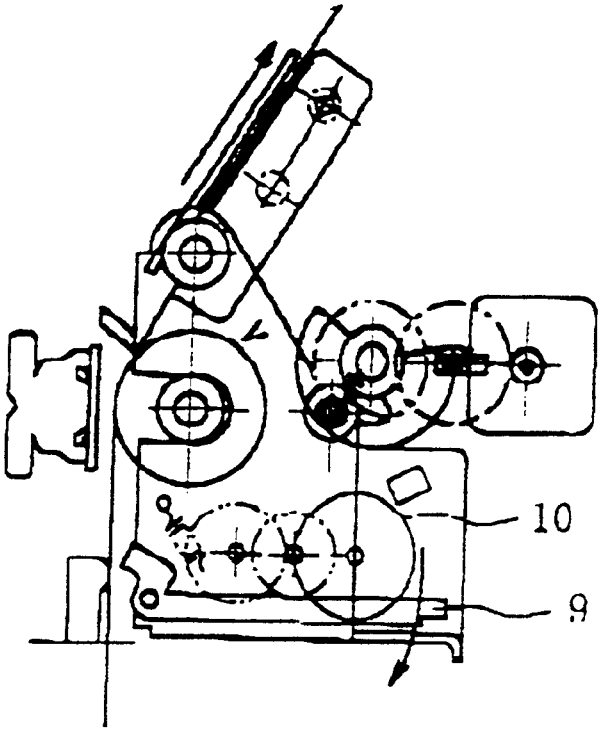
FIG. 15 schematically shows a sheet thickness detection procedure in the printer according to the embodiment of the present invention.

The printer of this embodiment is shown in more detail in FIGS. 13 to 15.

As shown in FIG. 13, sensor support 20 and lever arm 9 of sheet thickness detector 22 shown in FIGS. 6 and 7 are mounted on AGA frame 1 and LF frame 2. Bearing portion 4 is provided at a position in AGA frame 1 immediately above the center of platen 3, as a fulcrum of a rotary movement thereof. Shaft 5 inserted into bearing portion 4 is fixed to LF frame 2, so that AGA frame 1 is rotatably supported by LF frame 2.

AGA cam 6 for automatically regulating the platen gap is an isochronous cam and has a peripheral surface always in contact with a peripheral surface of cam follower 7 on AGA frame 1 by spring 8*b*.

On AGA frame 1, platen 3, lever arm 9 for sensing the sheet thickness, lever motor 10 for driving lever arm 9, transmission gear 11*a*, lever sensor 12 for detecting the position of lever arm 9 and cam follower 7 for converting power of AGA cam 6 into a rotary movement of AGA frame 1, etc., are mounted.

On LF frame 2, AGA motor 13 for driving AGA cam 6, transmission gear 11*b* and AGA home sensor 14 for sensing a home position of AGA cam 6 are mounted.

In this arrangement, a rotation driving force of motor 13 is transferred to cam 6 through transmission gears 11*b*, cam 6 pushes AGA frame 1 by rotation, and AGA frame 1 rotates around its shaft 5. That is, forward rotation of motor 13 moves the platen 3 to the left side of the drawing to shorten the gap between platen 3 and printing head 21, while reverse rotation of motor 13 moves platen 3 to the right side of the drawing to increase the gap between platen 3 and the printing head 21.

As shown in FIG. 14, the first printing position of sheet 40 is manually set to sheet set marker 15 by the operator. Upon a printing instruction. the first printing position of sheet 40 is pulled down to the position of lever arm 9 by tractor 17 and feed roller 18.

Then, lever arm 9 is released by lever motor 10 and, after lever sensor 12 is turned OFF, AGA frame 1 is moved toward the printing mechanism by AGA motor 13 and AGA cam 6 to decrease the platen gap. Lever arm 9 contacts a back surface of sheet 40 at a position of sensor support 20 in a midway of this movement of AGA frame 1. Lever arm 9 rotates by a repulsive force thereof to shield and optical axis of lever sensor 12 to thereby turn it ON. That is, lever sensor 12 is turned ON at a position in which the platen gap is small, the smallness being increased as the thickness of the sheet is decreased.

In this state, the number Xt of steps of AGA motor 13 from a start time from the home position to a time at which lever sensor 12 is turned ON is measured. It is possible to measure the thickness of sheet 40 according to (X0-Xt), where X0 is the step number when there is no sheet 40 and preliminarily measured.

Data of the step number At corresponding to the step number for (X0-Xt) is derived from gap table 28 such that an optimal platen gap corresponding to the measured thickness of sheet 40 is obtained and AGA motor 13 is stopped after it operates correspondingly to the step number At from the time instance at which lever sensor 12 is turned ON.

Thereafter, as shown in FIG. 15, lever arm 9 is withdrawn from a sheet transportation path by lever motor 10 and printing is performed by advancing sheet 40 such that the first printing position aligns with the printing mechanism 19.

Further, as shown in FIG. 12, gap table 28 is set such that the narrower the air gap is the thicker sheet 40.

As described hereinbefore, according to the first embodiment of the present invention, the mechanism for setting the platen gap is simplified and precise. Further, the present printer can accommodate even printing sheets partially different thickness and can set the platen gap appropriate to the thickness of the printing sheet used.

Figure 16:
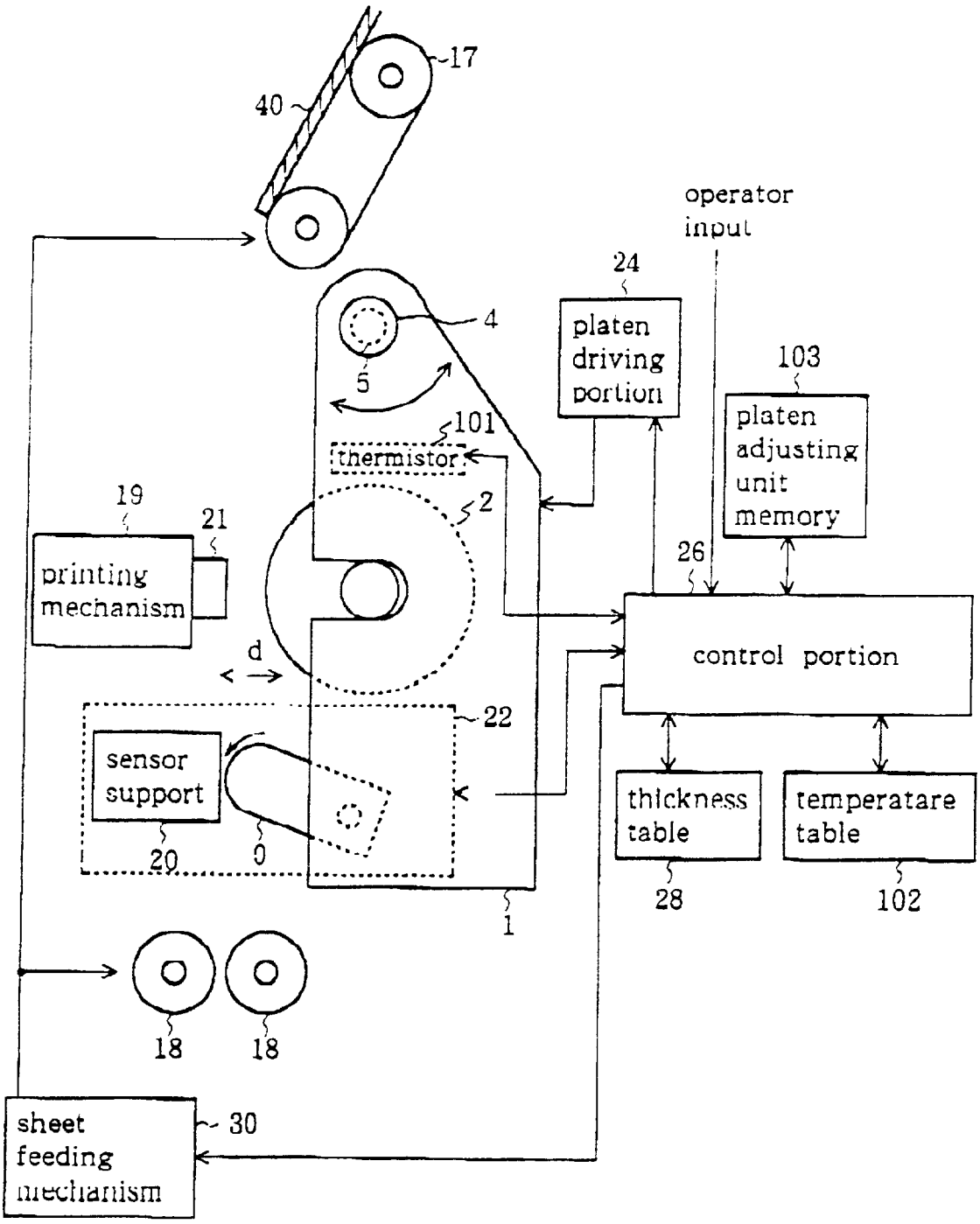
FIG. 16 shows a block circuit diagram of a main portion of the second embodiment of the present invention.

FIG. 16 shows a main part of the second embodiment of the present invention which comprises printer head 21, platen 3 arranged face to face with printing head 21 with a gap therebetween, feed roller 18 as means for feeding printing sheets into the gap between the printing head 21 and the platen 3, thermistor 101 as means for detecting the temperature of the platen 21, and control portion 26 and platen drive portion 24 as means for adjusting the gap automatically by a predetermined value ±Δd for reducing changes of the gap corresponding to temperature information output from the means for detecting.

In this embodiment, the center axis ofplaten 3 is supported between two walls of AGA frame 1. AGA frame 1 is supported by shaft 5 by bearing portion 4 provided on the upper side of AGA frame 1 so that AGA frame 1 can rotate slightly around shaft 5. Control portion 26 is constructed by a programmable control circuit of which control outputs are supplied through platen drive portion 24. Platen drive portion 24 includes electricity machine conversion means to change the position of AGA frame 1 around shaft 5.

Figure 17:
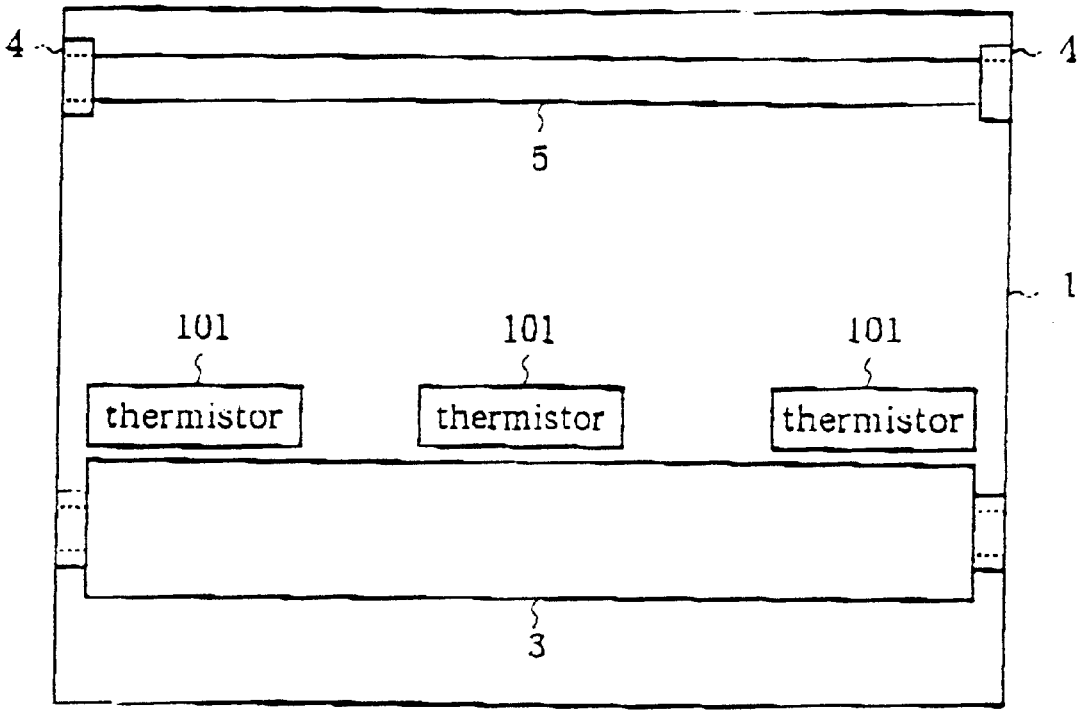
FIG. 17 shows an arrangement of means for detecting temperature.

FIG. 17 shows an positional relation between a platen and thermistors. Three thermistors 101 are provided near platen 3 to supply electrical signals corresponding to the temperature of platen 3 as a temperature information to control portion 26.

Printing head 21 is driven by printing mechanism. The gap between printing head 21 and platen 3 is d. Printing sheet 40 is fed by a pair of feed roller 18, passes through the gap of platen 3 and printing head 21 and is driven by tractor 17 according to the printing state. Feeding of the sheet is controlled by feeding mechanism 30.

Printing sheet 40 passes through sheet thickness detector 22 which detects the thickness of the sheet. That is, when sheet 40 passes between lever arm 9 and sensor port 20, the thickness of sheet 40 is detected as an angle of lever arm 9 pushing sheet 40 to be supplied into control portion 26 as a thickness information.

Control portion 26 comprises temperature table 102 and thickness table 28 and is supplied an adjusting unit for the gap d between the printing head 21 and the surface of the platen 3 from platen adjusting unit memory 103. Control portion 26 uses the thickness information input from sheet thickness detector 22 to refer to the thickness table 28, calculates a changing amount of the platen position, and changes the platen position through platen drive portion 24. Control portion 26, further, uses a temperature information input from thermistor 101 to refer to temperature table 102, recognizes an amount for changing the platen positing corresponding to the temperature information, changes the platen position during a return period of the printing operation by an adjusting unit indicated by platen adjusting unit memory 103 through platen drive portion 24.

In platen adjusting unit memory 103, information is stored about a unit distance by which the gap is adjusted at a time. The unit distance corresponds to the distance by which the gap is adjusted without visible change on the printing finish. If the amount to be adjusted is smaller than the unit distance, it should be adjusted after the amount comes to the unit distance.

Figure 18:
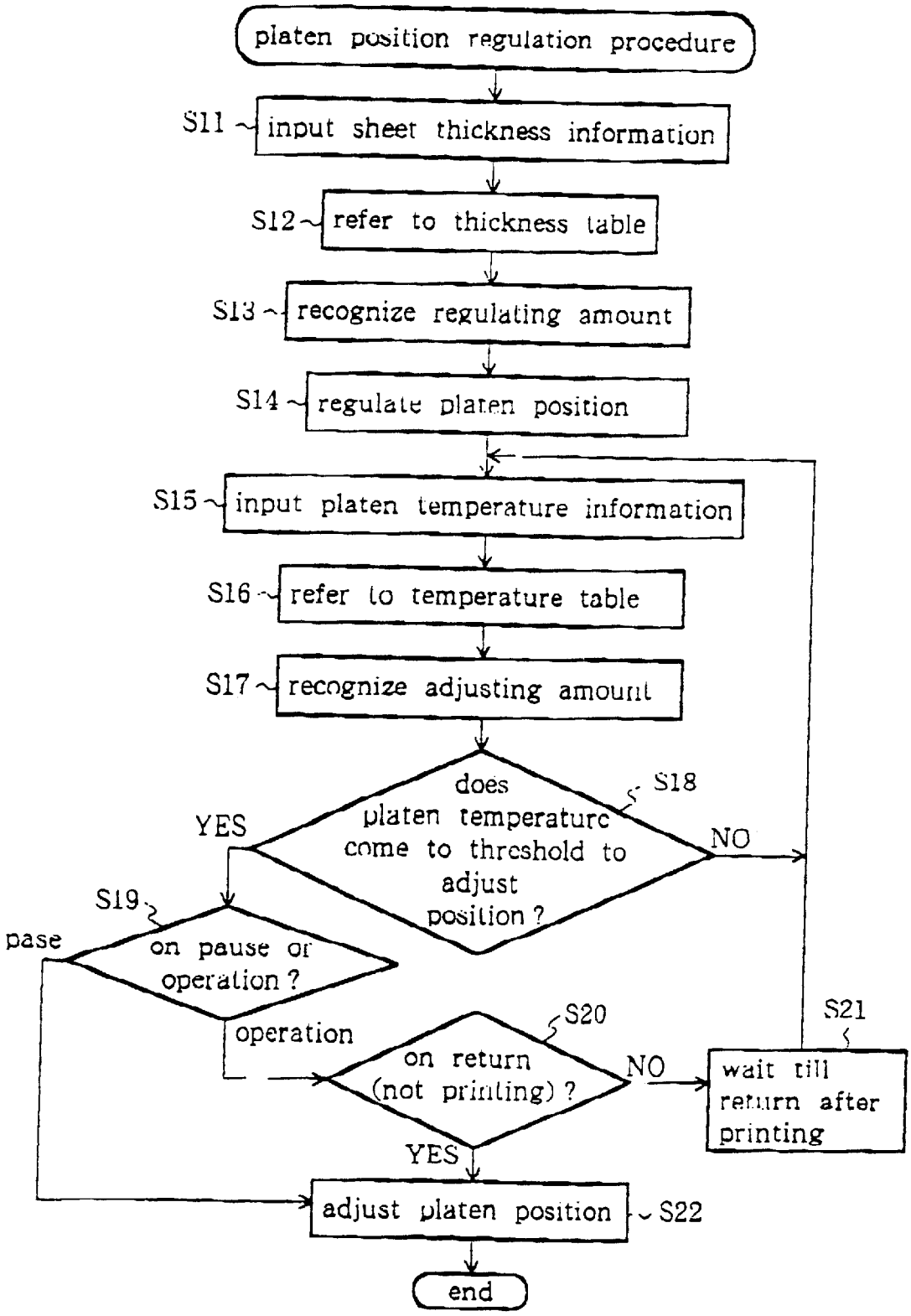
FIG. 18 is a flowchart showing a control procedure of a control portion.

FIG. 18 shows a flowchart of a main part of control software by which control portion 26 operates. It will be shortly explained the operation for adjusting the platen position. On a printing sheet fed, control portion 26 receives a thickness information for the sheet (S11). Then, control portion 26 refers to the thickness table (S12), recognizes an amount to be adjusted (S13) and executes platen position adjustment (S14). Next, control portion 26 receives a platen temperature information (S15), refers to the temperature table (S16) and recognizes an amount to be adjusted (S17). Control portion 26 then decides whether the amount comes up to the threshold to be adjusted (S18). If it does not come up, it returns to the temperature information receiving step (S15). If it comes up, control portion 26 checks whether the printing operation is on pausing or on operating (S19). If it is on operating, control portion 26 further checks whether it is on returning (S20) and executes a platen position adjustment (S22) until the return operation is finished (S21).

Figure 19:
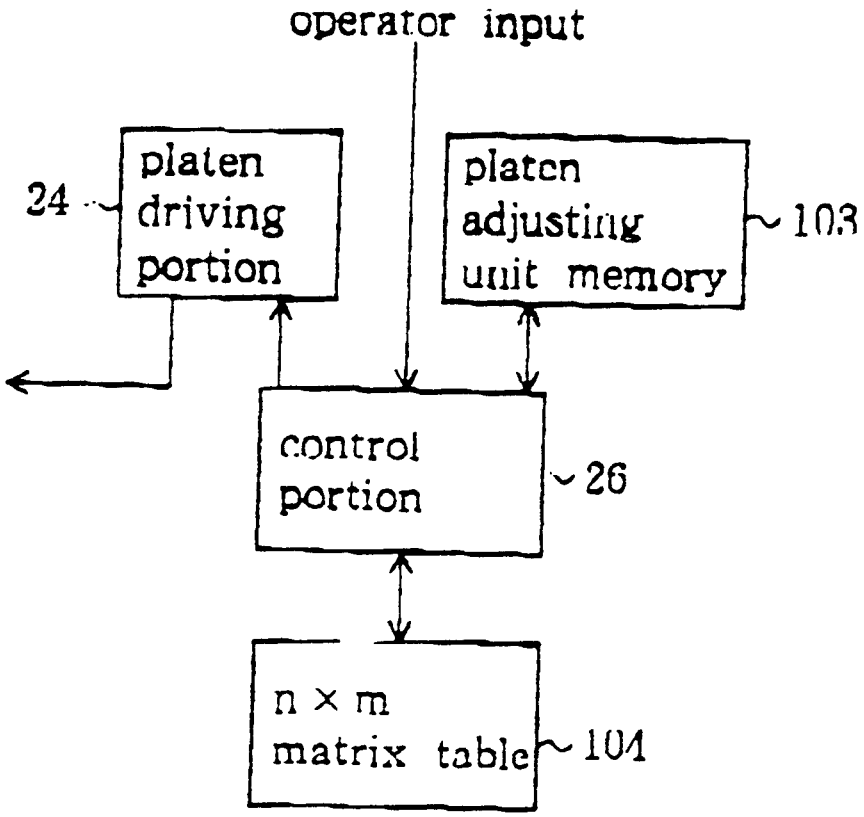
FIG. 19 shows a block circuit diagram of a main portion of the third embodiment of the present invention.

FIG. 19 shows a block circuit diagram of a main portion of the third embodiment. The embodiment is characterized by storing values corresponding to the value ±Δd deviated from the standard value d0 of the gap d between platen 3 and printing head 21 in an n×m matrix memory 104. Other arrangements are same as that of the second embodiment.

In this embodiment, sheet thickness information and temperature information are classified into n and m steps, respectively, while there is provided in a memory a matrix control table which stores values corresponding to n×m values (±Δd). On receiving a sheet thickness information and temperature information, control portion 26 reads one of the n×m values with reference to control table and adjusts the platen by the adjusting unit to become the gap d into d0 ±Δd.

As described hereinbefore, according to the second embodiment of the present invention, there is provided a printer in which printing quality does not change even if the temperature of the platen varies during printing execution. Such a printer is provided at a low cost by the present invention. On the printer of the present invention, printing quality does not change even if the printing is continued or interrupted. No ink ribbon may contact carelessly with the printing sheet surface to stain the print finish.

What is claimed is:

1. A printer comprising:

a print head moveable along a printing path;

a platen having an outer surface parallel to and spaced from said printing path and defining a gap between said outer surface and said print head;

a pivotable support coupled to said platen, said support pivoting in such a manner that said platen outer surface moves arcuately towards and away from said printing head;

a detector for detecting a temperature of said platen; and an actuator for pivoting said support in response to said detected temperature of said platen so as to adjust the size of said gap.

2. The printer according to claim 1, wherein said support comprises:

a shaft arranged parallel to and spaced from said platen; and a frame pivotally attached to said shaft and supporting said platen for said arcuate movement thereof.

3. The printer according to claim 2, wherein said frame comprises a pair of arms pivotally coupled to said shaft at spaced locations along a length of said shaft, and supporting said platen at spaced locations along a length of said platen.

4. A printer according to claim 2, wherein said detector is supported by said frame.

5. The printer according to claim 1, wherein said actuator adjusts said size of said gap as a function of both said detected platen temperature and stored information indicating desired gap sizes for different platen temperatures.

6. The printer according to claim 1, further comprising a thickness detector for detecting a thickness of a printing sheet fed through said gap, said actuator further pivoting said support in response to said detected thickness of said printing sheet so as to adjust the size of said gap.

7. The printer according to claim 6, further comprising:

a first controller for operating said actuator so as to adjust said size of said gap as a function of both said detected thickness and stored thickness information indicating desired gap sizes for different sheet thicknesses; and a second controller for operating said actuator so as to adjust said size of said gap as a function of both said detected platen temperature and stored temperature information indicating desired gap sizes for different platen temperatures.

8. The printer according to claim 7, wherein said second controller operates said actuator during an interruption in the printing of said printing sheet by said print head.

9. The printer according to claim 7, wherein said second controller operates said actuator if said function of both said detected platen temperature and said stored temperature information is above a threshold value.

10. The printer according to claim 7, wherein said stored thickness information and said stored temperature information are contained within a table, said table including information corresponding to N×M gap sizes, wherein N corresponds to thickness information and M corresponds to temperature information.

11. A printer according to claim 1, wherein said detector is supported by said frame.

12. A printer according to claim 6, wherein said detector detects said thickness of said printing sheet before said sheet is moved into a printing position wherein said printing sheet is printed by said print head.

13. A printer according to claim 6, wherein said actuator varies the size of said gap in such a manner that a distance between the print head and the printing sheet in the gap decreases as the thickness of the printing sheet increases.

14. A printer comprising:

a print head moveable along a printing path;

a cylindrical platen having an outer surface that lies parallel to and is spaced from said printing path to define a gap therebetween, said platen being rotatable about a platen axis which extends parallel to said printing path, said platen being pivotally coupled to a support in such a manner that said platen axis can be arcuately moved towards and away from said printing path while said axis remains parallel to said printing path;

a feeder for feeding a printing sheet through said gap;

a detector for detecting a temperature of said platen; and actuator for pivoting said platen as a function of said detected temperature of said platen to adjust the size of said gap.

15. A printer according to claim 14, wherein said support comprises a pair of arms which are pivotal about a support axis lying parallel to and spaced from said platen axis, said arms being coupled to said platen at spaced locations along said platen axis.

16. A printer according to claim 15, wherein said arms are part of a frame.

17. A printer according to claim 16, wherein said detector is supported by said frame.

18. A printer according to claim 14, wherein said detector detects said temperature of said platen during an interruption in the printing of said printing sheet by said print head.

19. A printer according to claim 14, wherein said regulator adjusts said size of said gap as a function of both said detected platen temperature and stored information indicating desired gap sizes for different platen temperatures.

20. A printer comprising:

a feeder feeding a printing sheet along a sheet path;

a platen located along said sheet path and extending along a platen axis;

a printing head displaceable along said sheet path parallel to said platen axis and spaced from said platen across said path to form a gap with said platen, wherein the printing sheet is fed through said gap;

a detector located along said platen axis and detecting a temperature of the platen, said detector generating a signal corresponding to the detected temperature of the platen; and an actuator operatively connected to said platen to swing the platen along an arcuate path toward and away from said sheet path to adjust the gap between said platen and said printing head in response to said signal from said detector.

* * * * *

UNITED STATES PATENT AND TRADEMARK OFFICE

CERTIFICATE OF CORRECTION

PATENT NO. : 6,431,771 B2
DATED : August 13, 2002
INVENTOR(S) : Mikio Nagai et al.

It is certified that error appears in the above-identified patent and that said Letters Patent is hereby corrected as shown below:

Title page,
Item [73], Assignee, please insert -- and NTT Data Corporation, Japan -- after "NEC Corporation, Japan --.

Signed and Sealed this

Twenty-seventh Day of May, 2003

JAMES E. ROGAN
*Director of the United States Patent and Trademark Office*